United States Patent [19]

Sumner

[11] 4,361,007

[45] Nov. 30, 1982

[54] OPEN END SPUN SLUB YARN METHOD AND APPARATUS

[75] Inventor: John H. Sumner, Greensboro, N.C.

[73] Assignee: Burlington Industries, Inc., Greensboro, N.C.

[21] Appl. No.: 127,446

[22] Filed: Mar. 5, 1980

[51] Int. Cl.[3] ..... D01H 1/12; D01H 7/882; D01H 7/892; D02G 3/34

[52] U.S. Cl. ..... 57/409; 57/404; 57/408; 57/413

[58] Field of Search ..... 57/58.89, 58.91, 58.95, 57/91, 209, 317, 400, 404, 408, 409, 413, 209

[56] References Cited

U.S. PATENT DOCUMENTS

| | | | |
|---|---|---|---|
| 3,908,349 | 9/1975 | Urifu et al. | 57/58.95 X |
| 3,956,876 | 5/1976 | Artzt et al. | 57/58.95 |
| 3,968,636 | 7/1976 | Junek et al. | 57/58.95 |
| 4,109,454 | 8/1978 | Fehrer | 57/58.95 |
| 4,144,702 | 3/1979 | Pittman | 57/91 X |
| 4,160,359 | 7/1979 | Frentress | 57/58.89 |
| 4,201,037 | 5/1980 | Artzt et al. | 57/58.95 X |

FOREIGN PATENT DOCUMENTS

| | | |
|---|---|---|
| 2138487 | 3/1973 | Fed. Rep. of Germany . |
| 2657096 | 6/1978 | Fed. Rep. of Germany . |

OTHER PUBLICATIONS

German Publication 2657096, Messing, Pub. Date 6/22/78.

German Printed Application, Rohrberg, 2808589, Aug. 30, 1979.

*Primary Examiner*—Donald Watkins

*Attorney, Agent, or Firm*—Cushman, Darby & Cushman

[57] ABSTRACT

The invention relates to a method of and an apparatus for open-end spinning a novelty yarn (especially slub yarns), and the yarn so produced. A sliver is fed to the fiber separating device of an open-end spinning apparatus to form distinct fibers, the fibers are air transported in a fiber flow path to the twisting device, controlled formation of effects (particularly slubs) is effected during air transport of the distinct fibers in their path, the formed effects are intermittently passed to the twisting device (e.g. pseudo-randomly), the fibers fed to the twisting device are twisted into a continuous strand of effect yarn (particularly slub yarn), and the continuous strand of effect yarn is taken up. The controlled formation of effects is preferably accomplished by introducing a needle into the fiber flow path in the transport section, the fibers collecting on the needle. The fibers are passed to the twisting device by withdrawing the needle from the fiber flow. Virtually any type of conventional open-end spinning apparatus may be modified to practice the slub yarn spinning according to the invention.

8 Claims, 19 Drawing Figures

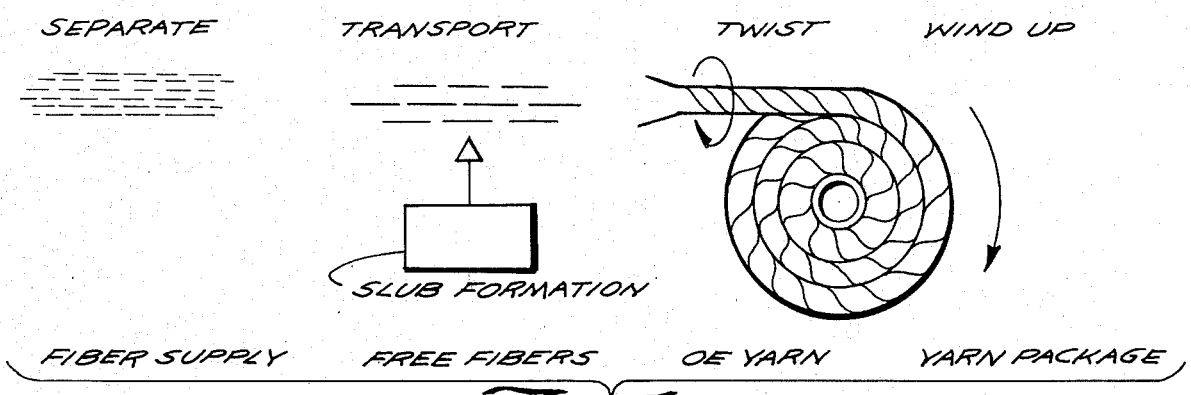
Fig. 1
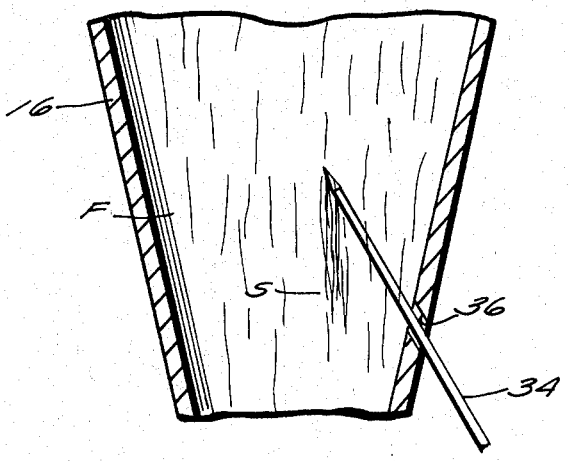
Fig. 3
Fig. 4a
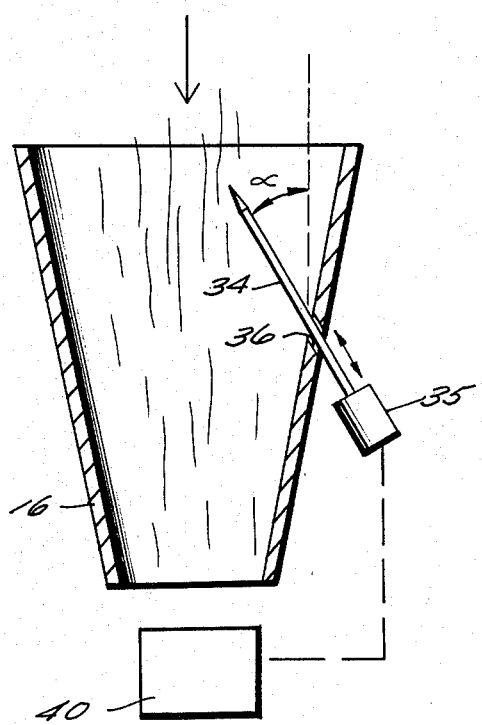

Fig. 4b
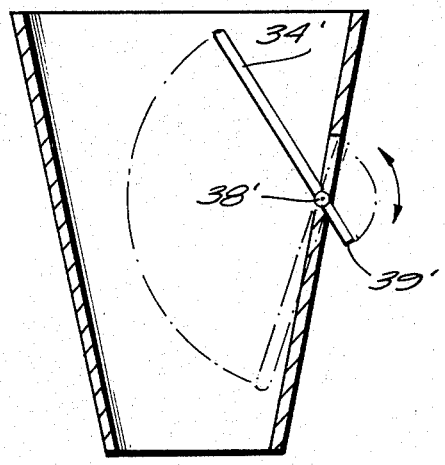
Fig. 4c
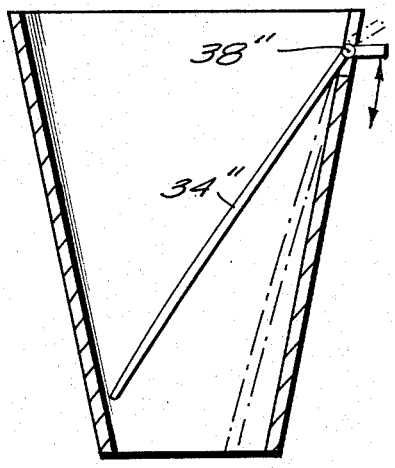
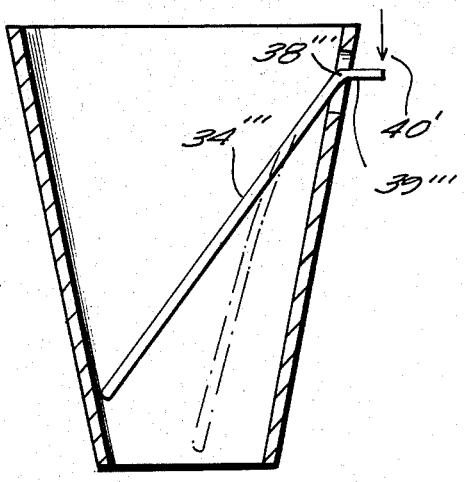
Fig. 4d
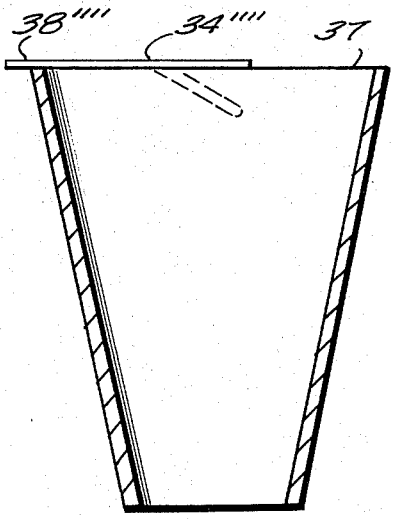
Fig. 4e

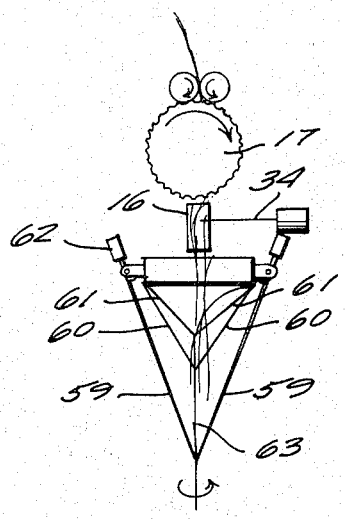
Fig. 9
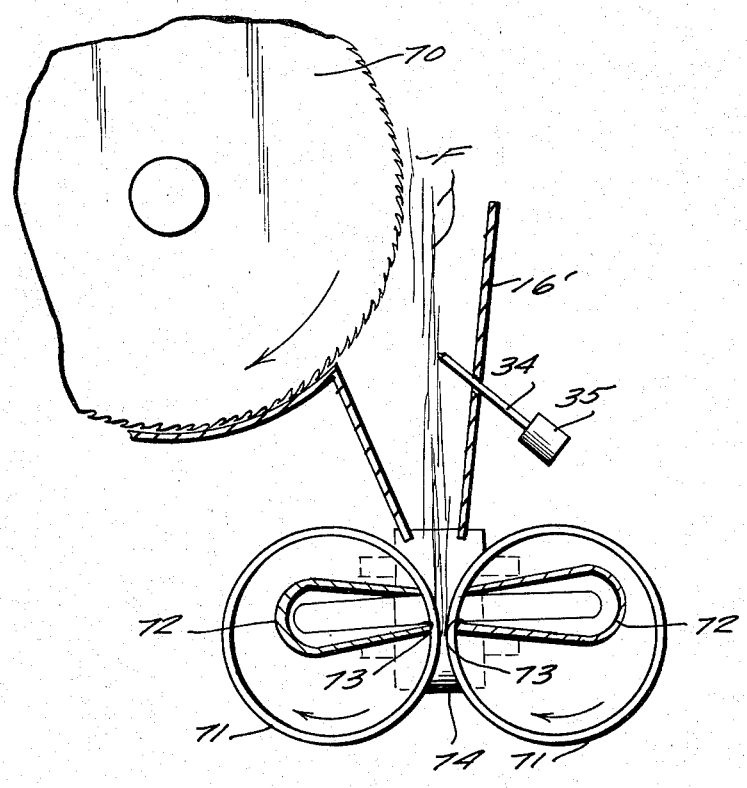
Fig. 10
Fig. 11
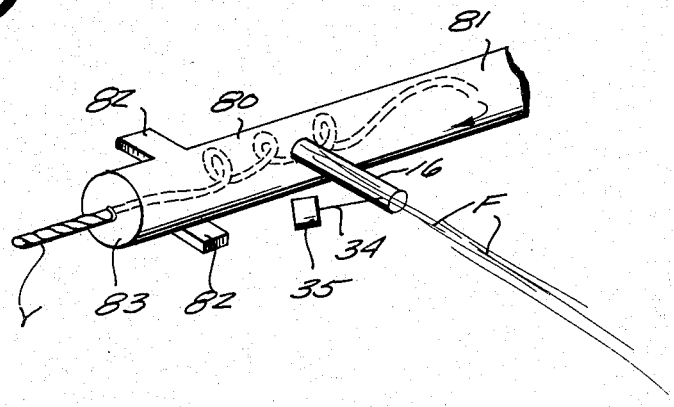

OPEN END SPUN SLUB YARN METHOD AND APPARATUS

BACKGROUND AND SUMMARY OF THE INVENTION

Open-end spinning of yarn is becoming increasingly commercially popular because of a number of inherent advantages of open-end spinning over conventional ring spinning. Some of the advantages of open-end spinning over ring spinning are: yarn formation and winding are not interdependent, allowing for removal of full packages while the machine is running; package size is theoretically unlimited; power consumption increases little with package weight; and package shape is suitable for most of the succeeding operations so that rewinding is eliminated. Additional advantages are the appearance, processability, and economy of the open-end yarns, and generally improved performance of end-products made with open-end yarns.

While it is desirable to be able to produce open-end novelty yarns (particularly open-end slub yarns), there have been a large number of practical problems associated with conventional techniques and proposals for making open-end novelty yarns. As a result, most novelty (particularly slub) yarns now produced are ring spun. Present conventional and proposed methods for formation of slubbed open-end yarns include applying the slubs to the sliver before it is fed to the spinner; rapidly increasing or decreasing the feeding rate of the sliver; varying the withdrawal speed of the yarn from the spinner (U.S. Pat. No. 4,144,730); and forming the slubs exteriorly of the open-end spinning operation and then adding the slubs in a separate path to a point just before the yarn spinning device.

All conventional and proposed techniques for making open-end novelty yarns have disadvantages associated therewith. For instance slubs added to the sliver require extra processing, they have a tendency to become lost as "trash" during the fiber separating stage (e.g. carding and combing), and they interfere with the combing of the fibers. Slubs made by controlling the feeding and withdrawal speeds of the sliver and yarn respectively do not allow production of a wide variety of different types of novelty yarn, and the slubs produced have a character that is undesirable for many operations. The feeding of slubs in a different path exterior of the open-ended spinning device requires the construction of an entirely separate system which can be expensive, takes up valuable room, and does not lend itself to ready adaptation to pre-existing equipment.

According to the method and apparatus of the present invention, most of the drawbacks associated with conventional and proposed techniques for open-end novelty yarns have been overcome, and it is possible to produce novelty yarns (particularly slub yarns) having most of the desirable features of conventional ring-spun slub yarns. The method is subject to wide applicability and ready control to produce a wide variety of different novelty effects, and the apparatus according to the present invention is basically simple and is believed to be adaptable for use on almost any type of conventional open-end spinning equipment, and in fact can be retrofit onto most conventional open-end spinning equipment.

According to one aspect of the method of the present invention the open-end spinning of a novelty yarn is practiced utilizing an open-end spinning apparatus having a fiber separating device, a twisting device, and a fiber transport section interconnecting the separating and twisting devices. The method comprises the steps of effecting controlled formation of effects (preferably slubs) in the fiber transport section, and intermittently passing these effects to the twisting device. The effect formation step is preferably accomplished by introducing a physical structure, such as an elongated needle, into the fiber stream in the transport section to cause fiber collection thereon. Preferably the needle—or a plurality of needles—is inserted into and withdrawn from the fiber stream in the transport section on a pseudo-random basis, producing pseudo-random slubs and the desired configuration of slub yarn.

The invention is useful for making a wide variety of novelty yarns, which in general includes any yarn having unusual or special effects such as nubs, neps, lumps, slubs, or the like. However the invention is primarily suitable to the production of slub yarns. Slub yarns are a particular species of novelty yarn with soft, thick, unevenly twisted lengths which alternate with essentially normalsized places in the yarn. Slub yarns provide a very definite and readily discernible texture effect in the products into which they are made, the degree of course being dependent upon the frequency and size of the slubs, providing well defined, relatively large surface manifestations in the products produced with the yarn.

According to another aspect of the present invention a method of open-end spinning a novelty yarn from a sliver utilizing a fiber separating device and a twisting device is provided. The method consists essentially of the following steps: (a) Feeding the sliver to the fiber separating device to form distinct fibers. (b) Air transporting the distinct fibers in a fiber flow in a predetermined general path to the twisting device. (c) Effecting controlled formation of effects during air transport of the distinct fibers in said general path. (d) Intermittently passing the formed effects to the twisting device. (e) Twisting the fibers fed to the twisting device, including any effects passed thereto, into a continuous strand of novelty yarn; and (f) Taking up the novelty yarn continuous strand. Step (c) is preferably accomplished by the pseudo-random insertion and withdrawal of one or more needles into and out of the fiber flow path, and the formed effects are preferably passed to the twisting device pseudo-randomly, responsive to the control of the insertion into and withdrawal from the fiber flow path of the needles.

The apparatus for practicing the present invention comprises a spinning device including a fiber separating device, a twisting device, and a fiber transport section disposed between the separating and twisting devices. The fiber separating device may be of any conventional type such as a conventional opening roll, and the twisting device may also be of any conventional type such as a rotor. According to the present invention means for effecting controlled formation of effects in the fiber transport section and for intermittently passing the formed effects to the twisting device are provided. The particular means preferably includes one or more needles and a means associated with each needle for intermittently (e.g. pseudo-randomly) inserting the needle into and withdrawing it from the fiber transport section (such as through the wall of the fiber transport tube).

By practicing the method according to the present invention a novelty yarn in general, and a slub yarn in particular, is produced that has the desired variety and many characteristics of conventional ring spun slub yarns, and the invention may be practiced in a simple, inexpensive, and effective manner.

It is the primary object of the present invention to provide a simple and practical method and apparatus for producing open-end novelty (particularly slub) yarns, and the yarn so produced. This and other objects of the invention will become clear from an inspection of the detailed description of the invention and from the appended claims.

BRIEF DESCRIPTION OF THE DRAWINGS

FIG. 1 is a diagram illustrating the principle of open-end spinning, including a modification thereof to produce novelty yarns according to the present invention;

FIG. 3 is a detailed sectional view illustrating fiber collection on a physical structure inserted in the fiber stream of the apparatus in FIG. 2;

Figure 5:
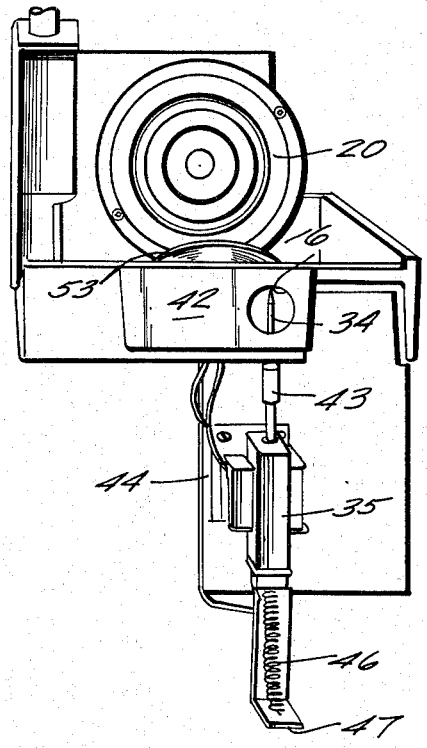
Figure 6A:
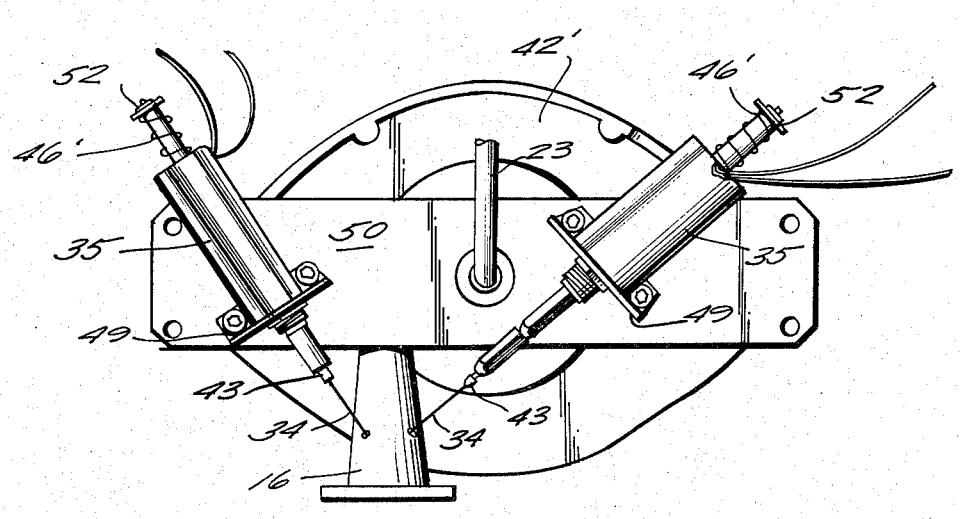

FIGS. *4a–4e* are detailed cross-sectional schematic views illustrating various forms the introduced physical structure according to the present invention may take;

FIG. 5 is a perspective view, with rotor cover pivoted to a rotor-exposing position, illustrating one embodiment of apparatus according to the present invention;

FIG. *6a* is an exposed front plan view of the fiber transport tube and rotor cover plate of an open-end spinning machine illustrating another embodiment according to the present invention; and FIG. *6b* is a view similar to FIG. *6a* for yet another slightly different embodiment;

FIG. *7a* is a side cross-sectional schematic view of one conventional open-end spinning machine incorporating the teachings of the present invention, and FIG. *7b* is a front plan view of the device of FIG. *7a;*

Figure 12:
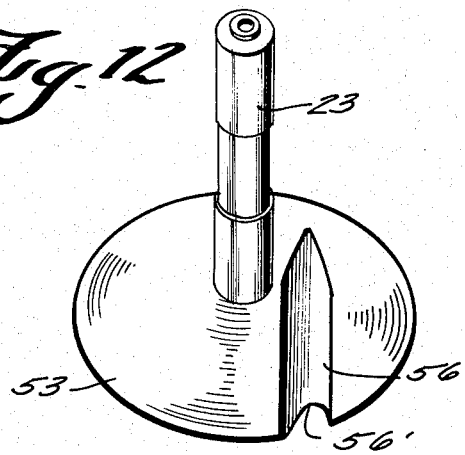
Figure 13:
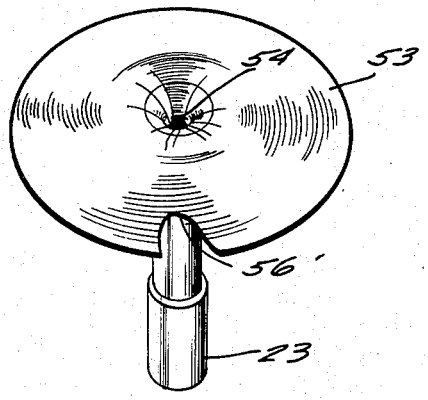
Figure 6B:
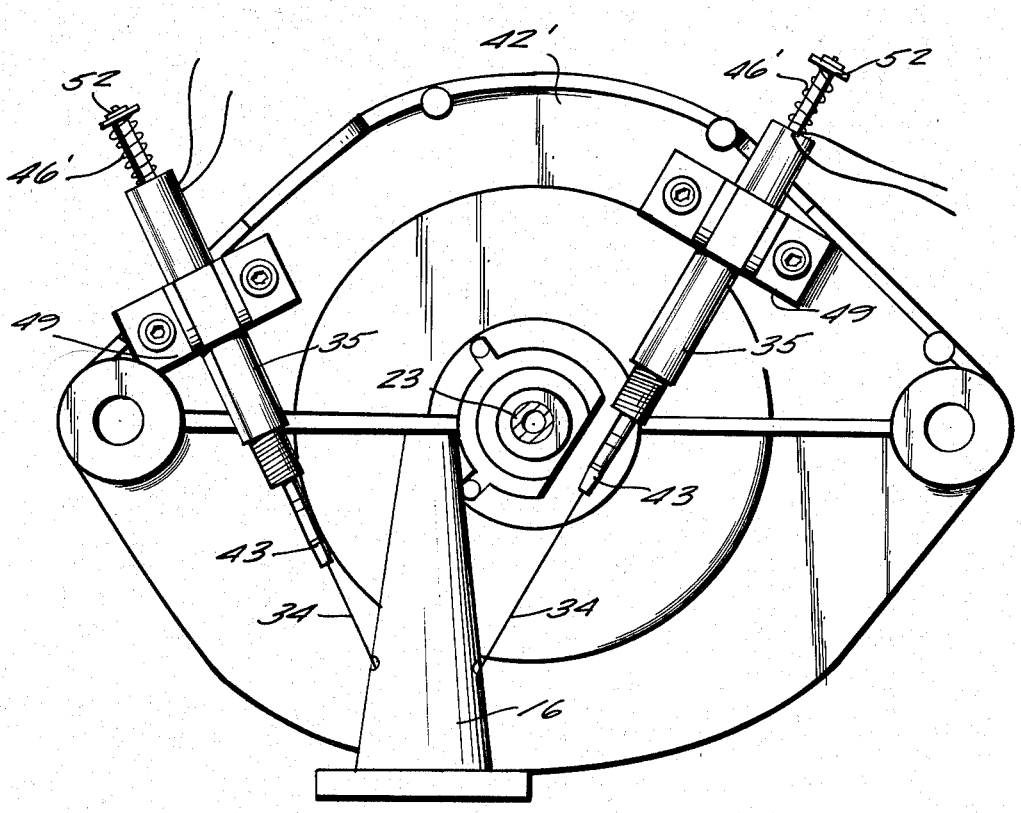

FIGS. 8, 9, 10, and 11 are schematic showings of other common open-end spinning machines employing exemplary apparatus according to the present invention;

FIG. 12 is a bottom perspective view of a modified separator plate utilized in the FIG. 5 unit; and FIG. 13 is an upper perspective view of the plate of FIG. 12.

DETAILED DESCRIPTION OF THE DRAWINGS

FIG. 1 shows an entirely diagrammatic representation of open-end spinning, illustrating the basic principles thereof. FIG. 1 indicates that in the first stage of the open-end spinning process the fibers are separated (from a source, such as a sliver) to provide a fiber supply. Next the individual separated fibers are transported as free fibers, primarily in a fiber transport section. The free fibers are then twisted to form the open-end yarn, and the yarn package is taken up. According to the present invention, the basic open-end spinning technique illustrated diagrammatically in FIG. 1 is modified so that novelty yarns in general, and slub yarns in particular, are produced. This is accomplished by forming effects from the free fibers during transport of the fibers from the separating to the twisting stages, and occasionally (preferably pseudo-randomly) allowing the effect fibers to pass to the twisting stage to be formed with the rest of the fibers flowing therewith into a slub yarn.

Figure 2:
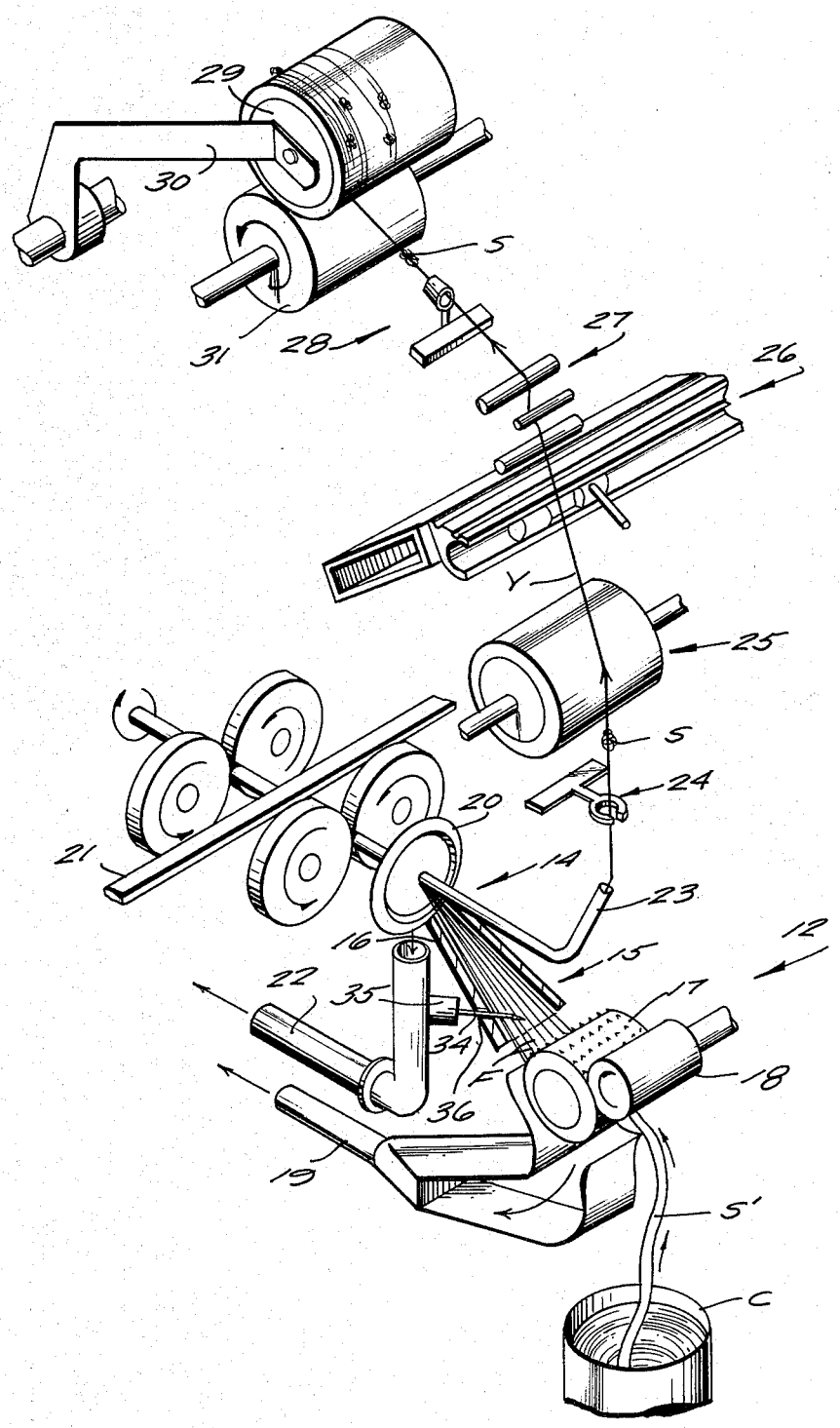
FIG. 2 is a diagrammatic exploded view illustrating all of the component parts of an exemplary open-end spinning machine according to the present invention.

An exemplary apparatus according to the present invention is illustrated schematically in FIG. 2. The structure illustrated therein comprises a conventional open-end spinning machine of the rotor type which has been modified to practice the present invention, the machine specifically illustrated being a modified SPIN-FLEX rotor spinning machine manufactured by Barber-Colman Company of Rockford, Ill.

The apparatus of FIG. 2 includes a fiber separating device, illustrated generally at 12, and a fiber twisting device, illustrated generally at 14. A fiber transport section 15, defined by a conventional fiber transport tube 16 having a decreasing diameter conical cross-section, is disposed between the separating 12 and twisting 14 devices.

In the FIG. 2 device, the separating device 12 comprises a conventional opening roll 17 which cooperates with a feed roll 18, and provides for the feeding of a sliver S' from a can C. The opening roll 17 separates the sliver S' into the individual fibers F, these being passed to the fiber transport section 15 while suction is provided by suction tube 19 for trash removal. The twisting device 14 illustrated in FIG. 2 comprises a rotor 20 which is powered by a conventional rotor belt 21, with suction for the rotor chamber being provided by the suction tube 22. Yarn produced by rotor 20 passes through yarn outlet tube 23 through a lower traverse 24 to a withdrawal roll 25. The yarn Y so formed then may pass past the "third hand" 26, compensator 27, and upper traverse 28 to the package 29 mounted on package arm 30. Take-up roll 31 cooperates with the package 29 to ensure proper take-up of the yarn Y.

All the components described heretofore in FIG. 2 are conventional. According to the present invention the apparatus of FIG. 2 is modified to simply and efficiently produce novelty yarns, particularly slub yarns. According to the present invention means are provided for effecting controlled formation of effects in the fiber transport section 15 and for intermittently passing the formed effects to the twisting device 14. The form that such means takes in FIG. 2 is a physical structure—that is the elongated needle 34—that is operatively connected to the solenoid 35 which comprises a means for moving the needle 34 into and out of the fiber transport section 15 through an opening 36 formed in the fiber transport tube 16. When the needle 34 is in the fiber flow in fiber transport section 15, fibers F collect along the length of the needle to from an effect—such as a slub S (see FIG. 3). When the needle 34 is withdrawn from the tube 16 by the solenoid 35, the slub S is released, then being passed to the twisting device 14, resulting in the yarn Y being a novelty yarn having effects (preferably slubs) S formed at different points along the length thereof.

In a preferred embodiment of the invention, illustrated in FIG. *4a*, the needle 34 is moved in and out by the means 35 so that it makes an angle with respect to the path of fiber flow. The objective of the needle is to serve as an intermittent obstacle in the path of the fibers, along the length of which obstacle a portion of the fibers drape themselves. These provide a slub when the needle is withdrawn and the accumulated fibers are released, to be carried with the main stream of fibers into the twisting device 14. The angle $\alpha$ may vary over a wide range from 0° to about 120°, being restricted in its lower size range by a somewhat more limited capacity for entrapping fibers and in its upper range by the tendency of the entrapped fibers to slide off the end of the down-slanting needle before the needle is withdrawn. A preferred range for $\alpha$ is approximately 25°–90°, with about 30°–45° being most generally preferred.

The needle may take the form of a conventional needle, but it may also be a pie-like wedge, a narrow ribbon-like strip, or the like. The term "needle" as used herein is used in a generic sense to indicate any of these structures. The needle is preferably small in cross-section; i.e., of itself it offers only a thin obstacle across the path of the fiber flow. Conveniently the needle may be pointed in the conventional manner of needles, but it may equally well be flat- or round-ended. The needle is most commonly straight, but given more sophisticated thrusting apparatus, it may also be curved upward or downward into the fiber stream. The path of the thrust of the needle into fiber transport tube 16 is preferably across one-third to three-fourths of its inside diameter, though shorter or longer thrusts may be employed if desired. It is apparent that compared to an $\alpha$ of 90°, the actual length of thrust of the needle through the wall of the transport tube will be greater, for a given percentage crossing of the tube diameter, the nearer $\alpha$ approaches 0°.

Figure 7A:
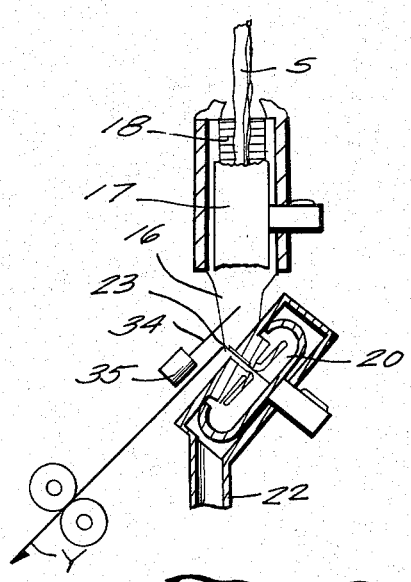
Figure 7B:
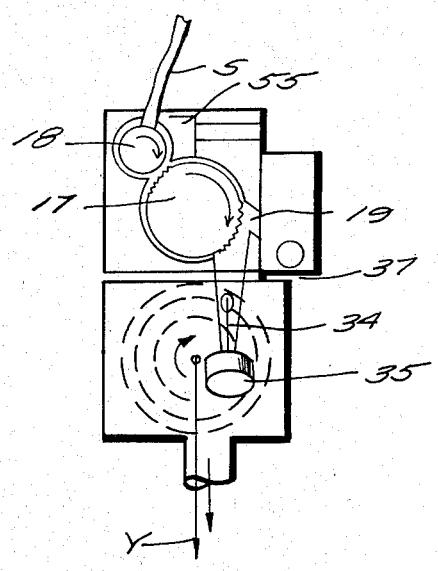

It is highly desirable, whatever the value of $\alpha$, that the inward thrust of needle 34 not carry its point beyond the intake edge 37 of fiber transport tube 16 (also shown in FIG. 7*b* as the hookup junction line 37 of fiber transport section 15 and fiber separating device 12). In practice fiber transport section 15 is commonly brought into and out of conjunction with separating device 12 by hinged means (not shown); and if the needle of the invention is permitted to overlap the junction line, there exists unnecessary risk of the needle being damaged if it is ever left unretracted when the fiber transport section is swung out.

Space limitation problems associated with fitting the needle(s) and drive means 35 to actual open-end spinning machines, where space tolerances are very restrictive, generally complicate the use of very low or very high values of $\alpha$. The special attraction of a low value of $\alpha$, as will be evident from consideration of FIG. 4*a*, is that it offers the possibility of making more dense and compact slubs as the result of the accumulated fibers sliding down the needle and packing into the point of the angle between needle and wall.

It is evident that, particularly for values of 0°–90° in the embodiment of FIG. 4*a*, the amount of accumulation of slub fibers varies directly with the size of $\alpha$, the thrust of the needle, and the time the needle remains in the fiber transport tube.

In another embodiment of the invention, shown in FIG. 4*b*, the in-and out motion of the needle 34 is replaced by the rotary motion of needle or elongated member 34', pivotally mounted to fiber transport tube 16 at 38', and having a portion thereof 39' operatively connected to a solenoid 35' or like power means. In this embodiment the same considerations concerning the value of angle $\alpha$ as in FIG. 4*a* control the location of the upward position of needle 34'. The release of the accumulated slub fibers is effected by dropping the needle to its downward position as depicted. In this position the slub is stripped from the needle by the air and fibers flowing through the transport tube.

In another embodiment of the invention, shown in FIG. 4*c*, needle 34'' rotates through a relatively short arc at pivot 38'' under the up and down action of solenoid 35''. The distal end of the needle optimally lightly contacts the opposite wall of the transport tube, although it has been found that a gap of about 1 mm is permissible because the fibers sliding down the inclined needle tend to fill and bridge the gap almost instantly when the needle end moves close to the wall. The collected slub fibers slip off into the fiber stream when the needle is moved away from the wall as indicated by the dotted lines.

The introduction and withdrawal of the needle or elongated body members of FIGS. 4*a*, 4*b*, and 4*c* into and out of the fiber stream may in theory be done manually, but in actual practice an automatic control mechanism is highly desirable. If desired a patterned, regular schedule of control impulses may be supplied by the controller to yield a consistent pattern of slubs in the product yarn. In most instances, however, in order to prevent undesired patterning in fabrics made from the yarn, control of the introduction and withdrawal of the needle or elongated body member, or members, within fiber transport tube 16 preferably is pseudo-random. Such a pseudo-random control is preferably accomplished by utilizing a suitable randomizer 40 (see FIG. 4*a*), operatively connected to the control solenoids (e.g. 35', 35''). Preferably, the randomizer is a Pugh randomizer, such as shown in U.S. Pat. No. 3,748,648, the disclosure of which is hereby incorporated by reference herein.

While the externally controlled embodiments of FIGS. 4*a*, 4*b*, and 4*c* are preferred, self-controlled means for collecting and releasing the slubs within the fiber transport tube are also surprisingly effective. One such embodiment, closely related in appearance to that of FIG. 4*c*, is shown in FIG. 4*d*. Here elongated member 34''' comprises a length of piano wire, thin spring steel, or similar moderately stiff but nonetheless flexible metal or plastic strip material. The upper end of member 34''' may be fixed at point 38''' such that its lower end exerts a spring-like constant light pressure against the opposite wall of the fiber transport tube. Preferably, potential for precisely adjusting the tension of the elongated member against the tube wall is provided by screw or other variably adjustable means 40' acting against the extension 39'''. The slub fiber accumulates in the angle between the elongated member and the lower tube wall. The mass of the slub and the pressure of the fiber and air stream against it gradually bend member 34''' inward sufficiently to permit the slub to slip out at intervals through the resulting gap, as represented by the dotted line. This means of collecting and releasing slub material is very simple to set up and operate, but it lacks the potential for continuously varying the slub size and spacing which an electronic control mechanism provides in the other embodiments.

Another self-controlled collection and release means is shown in FIG. 4*e*. In this embodiment needle 34'''' comprises a length of piano wire, thin spring steel, polyethylene terephthalate film, or the like flexible material, taped or clamped to junction surface 37 of fiber transport tube 16 at point 38'''' so that it sticks out into the stream of fibers. Point 38'''' may equally well constitute a hole lower down on the tube wall, with member 34'''' thrust through it. A typical example of this embodiment is a narrow wedge of 10-mil polyethylene terephthalate film, taped on junction surface 37 between separating device 12 and fiber transport section 15 of a Platt Saco Lowell 883 Rotospin unit so that the tip of a triangle with a 2-mm base projects 6 mm across the fiber stream entering transport tube 16. Fiber collects on the triangle until it bends sufficiently, as shown by dotted lines, for the aggregated fibers to slip off the needle and proceed to the twisting device 14. The plastic needle meanwhile returns to its starting position and the collection of fibers repeats itself.

While the physical structures for providing fiber collection to form effects in the fiber transport section 15 have been described as needles, there are other geometric configurations that also are suitable for providing effect formation. In general, any geometric configuration that allows fiber collection without unnecessarily restricting the general flow of fibers in the fiber transport section is suitable. Such a member is inserted in the fiber transport section 15 in such a position that it does not act upon substantially all the fibers in the fiber flow, provides no holding back force on the yarn being formed, and does not effect substantial reorientation of the majority of fibers in the fiber flow.

Preferred embodiments of the physical structure according to the present invention, in conjunction with conventional open-end spinning machines, are illustrated in FIGS. 5, *6a* and *6b*. In FIG. 5, a single needle 34 is operatively connected to a solenoid 35 for movement into and out of the fiber transport tube 16 of a Platt Saco Lowell 883 Rotospin unit, the transport tube 16 of this unit being molded into a cover plate 42 for the rotor 20, the cover plate 42 being mounted for pivotal movement from the open position illustrated in FIG. 5, to the closed, operating position. In a typical application of the invention the needle is mounted perpendicular to the axis of the transport tube at a point 6 mm below its entrance, and thrusts 6 mm into the tube. The solenoid 35 preferably is a push type solenoid, and the linearly movable element thereof is directly connected to a chuck 43 to which the needle 34 is removably attached. A stationary mounting plate 44 connects the solenoid 35 to the cover plate 42, and a return spring 46 acts between the movable element of the solenoid 35 and a bracket 47 stationarily mounted to the mounting plate 44.

In FIGS. *6a* and *6b*, two needles 34 are shown operatively associated with the fiber transport tube 16 of an Ingolstadt RU-11 open-end spinning machine unit viewed from the front and with the mounting cover removed. Again chucks 43 are provided directly connected to the solenoid 35 movable elements. In FIG. *6a*, the solenoids are mounted on stationary angles 49 to the centering plate 50 through which the yarn outlet tube 23 of the machine extends. The component 42' is the cover plate and transport channel for the machine. Return of the needles 34 to a position wherein they are withdrawn from the tube 16 is provided by return springs 46' acting between the cap 52 of the movable element of the solenoids, and the stationary outer casing of each solenoid 35. The needles 34 enter the transport tube 16 at angles $\alpha$, as defined in FIG. *4a*, of about 40° and 45° respectfully, and as depicted they do not, and/or need not, lie in the same plane with each other.

In yet another and more preferred embodiment on the Ingolstadt machine, as generally illustrated in FIG. *6b*, the two solenoids lie behind centering plate 50, i.e., between the centering plate and cover plate 42'. They are mounted directly on cover plate 42' in such a way that both lie in the same plane, with their needles 34 entering opposing sides of transport tube 16 at angles of about 25° and 30°, respectively. In this particular embodiment it is desirable that the thrusts of the needles be short enough that the needle tips cannot clash inside the transport tube.

In the FIGS. *6a* and *6b* embodiments, as well as in other embodiments employing two or more needles, the randomizer 40 is operated to control the solenoids so that each needle 34 is inserted into the transport tube 16 on a pseudo-random basis with one needle preferably being slightly delayed a varying amount of time relative to the introduction of the other needle. The FIGS. *6a* and *6b* embodiments are eminently suited for producing slub yarns having most of the desirable attributes of conventional ring spun slub yarns, and suitable for use for the production of drapery, upholstery, suiting, and other fabrics.

The Platt Saco Lowell 883 Rotospin unit depicted in FIG. 5 includes a slightly modified conventional circular separator plate 53 attached to the back of cover plate 42, the center of which separator plate constitutes a conventional navel 54 which in turn comprises the entry to yarn outlet tube 23. The separator plate 53, navel 54 and outlet tube 23 jointly comprise a single mushroom-shaped machine component, illustrated in FIGS. 12 and 13. The peripheral separator plate portion of this component serves conventionally to assure that the flow of fibers from fiber transport tube 16 to rotor 20 is direct and complete, as is well known in the art. The fiber flows across the back of the separator plate into the rotor.

To assure the smooth flowing of the mixture of fibers and slubs coming from the exit of fiber transport tube 16, a bullet-shaped groove 56 (see FIG. 12) about 30 mm long is cut across the conventionally contoured back surface of the Platt separator plate 53. This groove, 7 mm wide and having a maximum depth of about 3 mm, lies in line with the flow path of the fibers coming from the fiber transport tube, and terminates as a curved notch 56' in the opposite periphery of the plate. On the Platt 883 machine, in the absence of the groove, the slubs released in the fiber transport tube may tend to bounce off the back of the separator plate 53 and be drawn into the vacuum port beneath the rotor. The notch 56' terminating the groove 56, when viewed from the upper or navel side of the separator plate (FIG. 13), lies at about the one o'clock position on the plate 53 as illustrated in FIG. 5.

FIGS. *7a*, *7b*, 8, 9, 10, and 11 show a variety of conventional open-end spinning machines having a variety of different separating and twisting devices with which the apparatus according to the present invention may be utilized. In general, the apparatus according to the invention may be readily utilized with almost any conventional open-end spinning machine, and may be retrofit to most open-end spinning machines. The invention is utilizable with nearly all classes of open-end spinning machines including rotor systems, systems with axial aggregation of fibers, electrostatic systems, and vortex systems.

In FIGS. *7a* and *7b*, an elongated needle 34 according to the present invention is mounted for movement by a solenoid 35 into and out of transport tube 16 of a Platt Saco Lowell open-end spinning machine. This machine is generally similar to the SPIN-FLEX machine diagrammatically illustrated in FIG. 2 except that the yarn outlet tube 23 is not as elongated on the Platt, and the Platt is a downdraft machine. (In all of the open-end spinning machines described herein like reference numerals refer to like structures).

Figure 8:
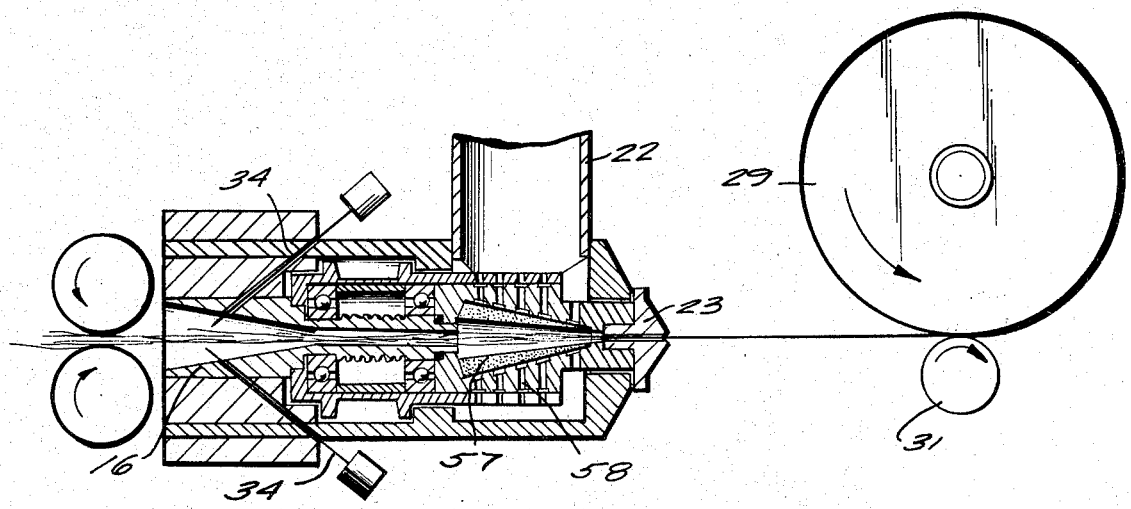

In FIG. 8, a plurality of needles 34 according to the present invention are illustrated in conjunction with the fiber transport tube 16 of a Sraitr-Bezstarosti open-end spinning machine. In this device, the rotor has a conical insert 57 of air-permeable material, with air from the rotor being sucked through the radial channels 58 connecting the rotor with the suction tube 22, the fibers accumulating on the conical surface of the permeable insert 57.

In FIG. 9, a single needle 34 according to the present invention is shown in operative association with the fiber transport tube 16 of a typical system with axial aggregation of fibers. The system illustrated in FIG. 9 is commonly called a Pavek open-end spinning device, and includes three sets of needles 59, 60, 61 mounted to counterweights 62 with a guiding needle 63 passing through the crests of the cones formed by the needles 59, 60, 61 and improving the parallelism of the fibers. A conventional combing roller 17 is provided as the fiber separating device.

FIG. 10 illustrates a needle 34 according to the present invention insertable and withdrawable by a solenoid 35 into and from the fiber transport tube 16 of a conventional DREF open-end spinning machine. The DREF spinning machine includes a conventional serated carding drum 70 as the fiber separating device, and the twisting device is formed by a pair of suction drums 71 each provided with a suction insert 72 which define confronting suction zones 73. The fibers F fall into the triangular region between the drums 71, with a pair of rolls 74 being provided at one end of the suction drums to serve and withdraw the resulting yarn and hold it against rotation at the same time.

FIG. 11 shows a needle 34 according to the present invention in operative association with a conventional air vortex open-end spinning system. In this system, the twisting device comprises a tube 80 extending generally perpendicular to the fiber transport tube 16 for the fibers F from the separating device (not shown). Suction is applied to one end 81 of the tube 80, air is introduced through ports 82 tangentially to the tube 80, and the yarn Y is withdrawn from the second end 83 of the tube 80, opposite the end 81.

Utilizing the apparatus according to the present invention heretofore described, a method of open-end spinning of a novelty yarn in an open-end spinning apparatus having a fiber separating device 12, twisting device 14, and fiber transport section 15 interconnecting the separating and twisting devices 12, 14 respectively may be practiced. The method comprises the steps of effecting controlled formation of effects (preferably slubs) in the fiber transport section 15 and passing those effects (preferably slubs) to the twisting device 14. The effect formation step is preferably accomplished by introducing a physical structure, such as a needle 34, 34', 34'', 34''' or 34'''' into the fiber transport section 15 to cause fiber collection thereon. Where the physical structure is an elongated flexible needle 34''' or 34'''', the passing step is practiced whenever the buildup of fibers on the flexible member is great enough to cause bending thereof to an extent sufficient to allow the release of fibers collected by the flexible member. Where the needle 34, 34' or 34'' is insertable into and withdrawable from the fiber flow in the fiber transport section 15, the passing step is accomplished by moving the needle out of functional contact with the fiber flow to release the effect (e.g. slub) S formed thereon. Preferably this insertion and withdrawal of the needle is random, being controlled by a Pugh pseudo-randomizer 40 or the like, although under some circumstances the control can be periodic if desired.

The method of open-end spinning of a novelty yarn Y from a sliver S' utilizing a fiber separating device 12 and a twisting device 14 according to the present invention consists essentially of the following steps: (a) The sliver S' is fed to the fiber separating device 12 to form distinct fibers F. (b) The fibers F are air transported in a fiber flow in a predetermined general path to the twisting device 14 (which path may be enclosed by a fiber transport tube (16). (c) Controlled formation of effects (preferably slubs) S is effected during air transport of the distinct fibers in the general flow path. This controlled formation is preferably accomplished by inserting a physical structure, such as a needle 34, into the fiber flow path. (d) Intermittently the formed effects (preferably slubs) S are passed to the twisting device 14. This is preferably accomplished by withdrawing the elongated needle 34 from the fiber flow path, which causes release of the slub S formed thereon. (e) The fibers are then twisted by the twisting device 14, including any effects S passed thereto, into a continuous strand of novelty yarn Y, and (f) the novelty yarn Y is continuously taken up as a continuous strand by the withdrawal roll 25 and take-up roll 31, onto a package 29.

The novelty yarn produced according to the method of the present invention may take a wide variety of forms, and may include slub yarns having essentially all of the desirable characteristics of conventional ring spun slub yarns, and is suitable for use in making drapery and other fabrics.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, structures, and products.

What is claimed is:

1. Apparatus for spinning a novelty yarn comprising an open-end spinning device including
   - a fiber separating device,
   - a twisting device,
   - a fiber transport section disposed between said separating and twisting devices, and
   - means for effecting controlled formation of effects in the transport section and for occasionally passing the formed effects to the twisting device, said means comprising an elongated flexible means, said means bending an extent sufficient enough to allow release of fibers collected thereby whenever the buildup of fibers thereon is greater than a predetermined amount.

2. Apparatus as recited in claim 1 wherein said means for effecting controlled formation of effects comprises means for effecting controlled formation of slubs.

3. Apparatus as recited in claim 1 wherein said twisting device comprises a rotor and a circular separator plate with yarn outlet tube extending outwardly from one face of said circular separator plate; and wherein said circular separator plate includes a bullet-shaped groove formed in said face thereof from which said yarn outlet tube extends, which groove lies in line with the flow path of fibers coming from said fiber transport section, and terminates as a curved notch on the periphery of said separator plate.

4. A method of open-end spinning a novelty yarn in an open-end spinning apparatus having a fiber separating device, a twisting device, an elongated flexible member, and a fiber transport section interconnecting the separating and twisting devices, said method comprising the steps of effecting controlled formation of effects in the fiber transport section by effecting controlled introduction of the flexible member, into the transport section to cause fiber collection thereon; and intermittently passing those effects to the twisting device whenever the buildup of fibers on the flexible member is great enough to cause bending thereof an extent sufficient enough to allow the release of fibers collected by the flexible member.

5. A method as recited in claim 4 wherein the fiber transport section comprises a tubular member, and wherein said controlled introduction of the elongated flexible member step is accomplished by providing the flexible member so that it extends from one side of the tubular member to the other side thereof and is fixed at said one side and extends angularly in the direction of fiber flow from the fixed location.

6. Apparatus for spinning a novelty yarn comprising an open-end spinning device including:

a fiber separating device;

a twisting device;

a fiber transport section disposed between said separating and twisting devices; and means for effecting controlled formation of effects in the transport section and for occasionally passing the formed effects to the twisting device; and comprises a rotor and a circular separator plate with yarn outlet tube extending outwardly from one face of said circular separator plate, the circular separator plate including a bullet-shaped groove formed in said face thereof from which said yarn outlet tube extends, which groove lies in line with the flow path of fibers coming from said fiber transport section, and terminates as a curved notch on the periphery of said separator plate.

7. Apparatus as recited in claims 1 or 6 wherein said transport section includes a tubular member that is conical in cross-section that surrounds the path of fiber flow.

8. Apparatus for spinning novelty yarn comprising an open-end spinning device including:

a fiber separating device;

a twisting device;

a fiber transport section disposed between said separating and twisting devices, said fiber transport section comprising a tubular member through which the fiber flows in a direction from the fiber separating device to the twisting device;

means for effecting controlled formation of effects in the transport section and for occasionally passing the formed effects to the twisting device, said means comprising an elongated member pivotally mounted with respect to said tubular member at one portion thereof and extending angularly in the direction of fiber flow from said pivotal location;

said elongated member being pivotally mounted adjacent one end thereof to said tubular member at a side wall comprising said tubular member, and having a free end which extends from said pivot mount into engagement, or substantially into engagement, with an opposite wall of said tubular member, and having a short arm portion extending from said pivot mount to the exterior of said tubular member; and said means for effecting controlled formation of effects further comprises solenoid means connected to said arm for effecting pivotal movement of said elongated member about said pivotal mount.

* * * * *